US010765174B2

(12) United States Patent
Peliks

(10) Patent No.: US 10,765,174 B2
(45) Date of Patent: Sep. 8, 2020

(54) SHOELACE SECURING DEVICE AND METHOD OF USE

(71) Applicant: Robert Peliks, San Francisco, CA (US)

(72) Inventor: Robert Peliks, San Francisco, CA (US)

( * ) Notice: Subject to any disclaimer, the term of this patent is extended or adjusted under 35 U.S.C. 154(b) by 278 days.

(21) Appl. No.: 15/477,095

(22) Filed: Apr. 2, 2017

(65) Prior Publication Data

US 2017/0303640 A1 Oct. 26, 2017

Related U.S. Application Data

(60) Provisional application No. 62/326,731, filed on Apr. 23, 2016.

(51) Int. Cl.

| | |
|---|---|
| ***A43C 7/00*** | (2006.01) |
| ***A43C 5/00*** | (2006.01) |
| ***A43B 23/02*** | (2006.01) |
| ***A43C 11/00*** | (2006.01) |
| ***A43B 11/00*** | (2006.01) |
| ***A43B 23/00*** | (2006.01) |

(52) U.S. Cl.

CPC ..... *A43C 7/00* (2013.01); *A43B 23/02* (2013.01); *A43C 5/00* (2013.01); *A43B 11/00* (2013.01); *A43B 23/00* (2013.01); *A43C 11/008* (2013.01)

(58) Field of Classification Search

CPC ..... A43C 7/00; A43C 11/008; A43C 5/00; A43C 7/005; A43C 7/02; A43C 7/04; A43C 7/06; A43C 7/08; A43C 9/00; A43C 9/02; A43C 11/00; A43C 1/00; A43C 1/02; A43B 23/00; A43B 11/00; A43B 23/02; A43B 3/28; A43B 3/30

USPC ..... 36/50.1, 112

See application file for complete search history.

(56) References Cited

U.S. PATENT DOCUMENTS

| | | | | | |
|---|---|---|---|---|---|
| 1,848,318 | A | | 3/1932 | Giotto | |
| 5,158,428 | A | * | 10/1992 | Gessner | A43C 1/003 24/712.1 |
| 5,291,671 | A | | 3/1994 | Caberlotto | |
| 5,325,613 | A | | 7/1994 | Sussmann | |
| 5,327,662 | A | | 7/1994 | Hallenbeck | |
| 5,467,511 | A | * | 11/1995 | Kubo | A43C 7/00 24/712.1 |
| 5,537,763 | A | * | 7/1996 | Donnadieu | A43C 1/00 36/50.1 |
| 5,996,256 | A | * | 12/1999 | Zebe, Jr. | A43C 3/04 24/134 P |
| D440,036 | S | * | 4/2001 | Zebe, Jr. | D2/972 |
| 6,324,774 | B1 | | 12/2001 | Zebe | |
| D460,858 | S | * | 7/2002 | Zebe, Jr. | D2/978 |
| 7,096,559 | B2 | | 8/2006 | Johnson | |
| 7,281,341 | B2 | | 10/2007 | Reagan | |
| 7,331,126 | B2 | | 2/2008 | Johnson | |
| 7,343,701 | B2 | | 3/2008 | Pare | |
| 7,631,440 | B2 | | 12/2009 | Keen | |
| 7,818,899 | B2 | | 10/2010 | Dinndorf | |
| 8,661,631 | B2 | * | 3/2014 | Palea | A43B 1/0081 24/304 |
| 9,532,626 | B2 | | 1/2017 | Lovett | |

(Continued)

*Primary Examiner* — Anna K Kinsaul
*Assistant Examiner* — F Griffin Hall

(57) ABSTRACT

A shoe fastening device and/or technique used to fasten a shoe is disclosed herein. A shoelace can be laced into a shoe in any number of lacing patterns. The two ends of the shoelace may be secured to the shoe. An overhand knot may be present when the shoelace is in a loosened configuration.

4 Claims, 3 Drawing Sheets

(56) References Cited

U.S. PATENT DOCUMENTS

| | | | | |
|---|---|---|---|---|
| 9,808,050 | B2 * | 11/2017 | Ben-Arie | A43C 7/04 |
| 2003/0177661 | A1 | 9/2003 | Tsai | |
| 2004/0172850 | A1 | 9/2004 | King | |
| 2006/0053659 | A1 | 3/2006 | Johnson | |
| 2006/0277728 | A1 * | 12/2006 | Ho | A43C 9/00 24/713.1 |
| 2009/0178257 | A1 * | 7/2009 | Boone | A43B 1/0081 24/712.2 |
| 2012/0009554 | A1 * | 1/2012 | Johnson | A43B 1/0027 434/260 |
| 2012/0174437 | A1 * | 7/2012 | Heard | A43C 1/04 36/50.1 |
| 2014/0007391 | A1 * | 1/2014 | Siegfreid | A43C 7/00 24/713 |

* cited by examiner

SHOELACE SECURING DEVICE AND METHOD OF USE

CROSS-REFERENCE TO RELATED APPLICATIONS

This application claims priority to U.S. Provisional Application No. 62/326,731 filed on Apr. 23, 2016, which is incorporated by reference herein in its entirety.

BACKGROUND OF THE INVENTION

Field of the Invention

This invention relates to shoes and shoelaces. More particularly, a shoelace securing device and a method for using the same are disclosed.

Description of the Prior Art

A number of devices and technologies have been developed for improved securing and/or retention of shoes and/or shoelaces. These range from replacements for shoelaces (e.g., Velcro) to accessories for shoelaces (e.g., shoelace clamps). Additionally, there are variations to the technique of lacing shoelaces, such as "lattice", "ladder", "zipper" and "sawtooth"; these different lacing patterns may offer different functional and/or aesthetic benefits.

SUMMARY OF THE INVENTION

A shoe fastening device and/or technique used to fasten a shoe is disclosed herein. A shoelace can be laced into a shoe in any number of lacing patterns; including, but not limited to: lattice, ladder, zipper, double back, loop back, bushwalk, sawtooth, footbag, display, hash, twisty, hidden knot, riding bow, checkerboard, and/or bi-colour. When tying a traditional bow with a shoelace, an overhand knot may be tied followed by a loop knot (a loop knot may be defined as a loop knot and/or a bow knot); subsequently, a double-knot may be used. The overhand knot may be formed by crossing shoelace ends so that they form an "X" in the air; wrapping the bottom lace of the "X" over and through the top lace of the "X". The loop knot may be formed by performing the following sequence: one of the shoelaces may be looped; the other lace may be wrapped around the base of the loop; the wrapping lace may be pushed under the loop and through the hole to form a second loop; and then finally the knot may be tightened (e.g., by pulling on the two loops). The overhand knot and/or loop knot may be formed using a different procedure. In one embodiment of this invention, the two ends of the shoelace may be secured to the shoe. The shoelace ends may be secured to the shoe by sewing, stitching, knotting, mechanically gripping, gluing, welding, brazing, soldering, fusing, melting, screwed and/or mechanically fastened. The ends of the shoelace may be rigidly fixed to the shoe and/or detachable from the shoe. Prior to securing the ends of the shoelaces to the shoe, an overhand knot may be tied. When putting the shoe onto the foot, the laces may be loosened. Sufficient slack may be present in the shoe lace such that minimal or no force is applied to the ends of the shoelaces that are secured to the shoe. To tie the shoelace, the lacing pattern may first be tightened by pulling on the loose ends and/or loops of the shoelace. If the overhand knot is already present, then the loops of the shoelace may be secured with a bow knot (e.g., a loop knot or bow knot may be performed by tying the loops together in a similar fashion to an overhand knot, thereby forming a bow). A secondary "double-knot" may also be applied. Upon completion, the tied shoelace may be functionally and aesthetically identical to a traditionally tied shoe lace; with the exception that the ends of the shoelace may be secured to the shoe.

The ends of the shoelace may be secured to various locations on the shoe. The two ends of the shoelace may be secured to the same or different locations on the same shoe. An end of the shoelace may be secured adjacent to the eyelet on the outside and/or inside of the shoe. An end of the shoelace may be secured to an eyelet of the shoe. An end of the shoelace may be secured into an eyelet of the shoe where the lace is already passing through.

The invention disclosed may offer a number of benefits over prior art. For example, by keeping the ends of the shoelace secured to the shoe, the knot may be less prone to being undone accidentally (e.g., by getting caught on something and/or being stepped on). Second, keeping the ends secured to the shoe may minimize the chance of the shoelace touching the floor and accumulating dirt and/or wear. Third, the shoelace may be unable to be undone accidentally (e.g., the end of the shoelace may be less prone to slipping out through an eyelet in the shoe). Fourth, the shoelace may be easier to tie and may require one less step if an overhand knot is already present. Additional benefits may be present, although not disclosed herein.

DETAILED DESCRIPTION

Figure 1:
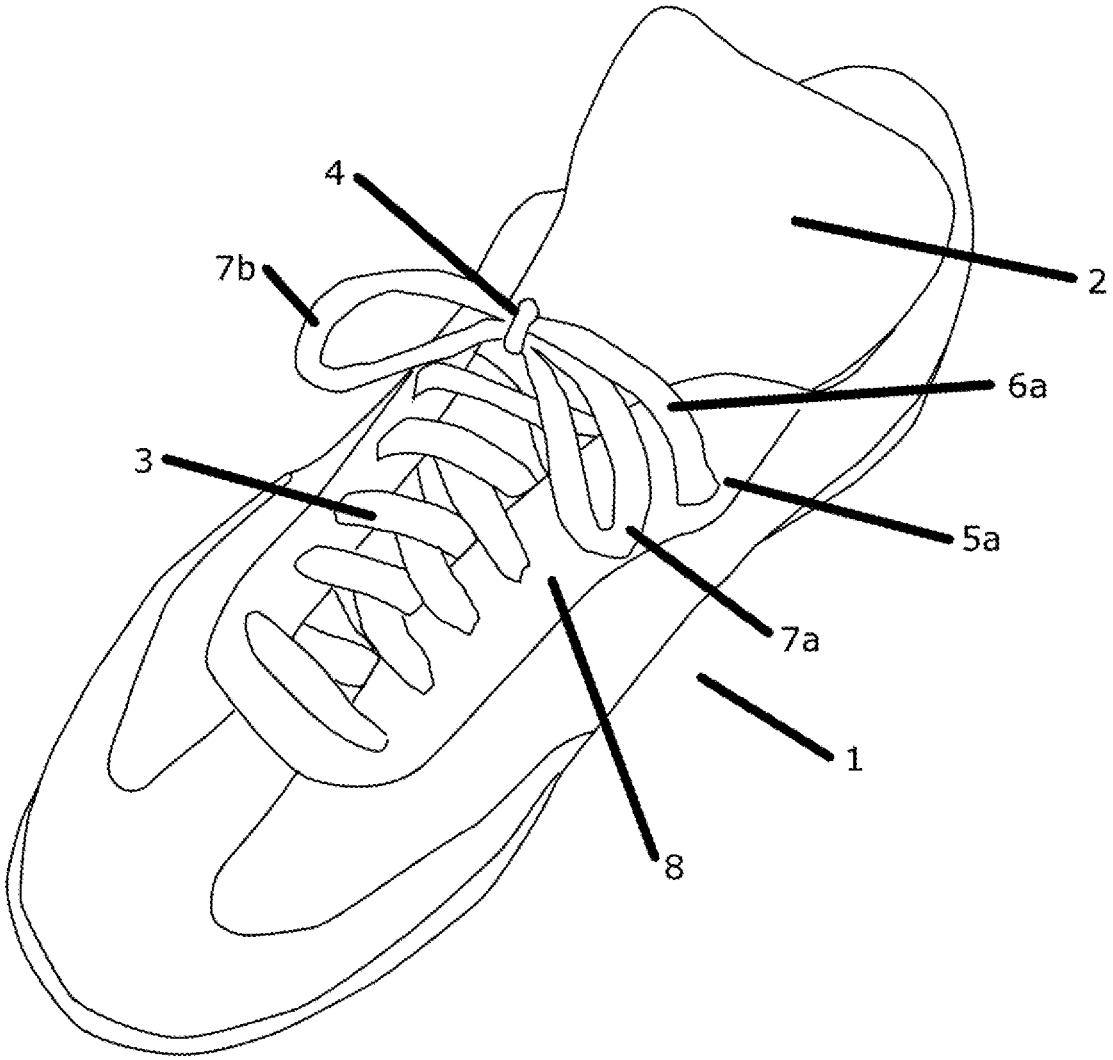
FIG. 1 is an illustrative isometric view of a variation of the shoe in the tied configuration.

FIG. 1 illustrates a shoe 1 with a tongue 2 and a shoelace 3. The shoelace 3 may be tied to secure the shoelace and tighten the shoe 1, for example the shoe 1 can be tightened around a foot. The shoe may also take other forms and/or shapes and be secured around other objects, such as a knee, an elbow, a wrist, a back, a shin, a shoulder, and/or a neck. The shoe may take other forms and/or shapes that can be secured around other objects, such as pipes and/or rods. The shoelace 3 may be tied into a bow with a loop knot 4. The loop knot 4 may be an overhand knot, a square knot, a bowline, a slip knot, a bow, or any other suitable knot for tying the shoelace 3. The tied shoelace 3 may have a loop 7*a* and/or 7*b*. The loop knot 4 may be centered or approximately centered on the shoe or it may be offset. For example, the loop knot 4 may be centered between the left and right sides of the shoe 1. The shoelace 3 may be laced in any number of configurations, including lattice, ladder, zipper, double back, loop back, bushwalk, sawtooth, footbag, display, hash, twisty, hidden knot, riding bow, checkerboard, and/or bi-colour. A vamp 8 may be made of synthetic and/or natural fibers. The vamp 8 may be leather, metal, cloth and/or plastic. The vamp 8 may have holes, eyelets and/or loops to lace the shoelace 3 through. A shoelace termination 5*a* and/or 5*b* may secure the end and/or the tip of the shoelace 3 to the vamp 8. The shoelace termination 5*a* and/or 5*b* may be secured to other sections of the shoe 1, such as the tongue 2, the sole, the heel, the quarter and/or the internal lining. For example, the shoelace termination 5*a* and/or 5*b* may be secured by sewing, stitching, knotting, mechanically gripping, gluing, welding, brazing, soldering, fusing, melting, screwing and/or mechanically fastening to a section of the shoe 1, such as the vamp 8. A shoelace end section 6*a* and/or 6*b* may comprise a length of approximately 3 inches adjacent to the shoelace termination 5*a* and/or 5*b*. The shoelace end section 6*a* and/or 6*b* may be longer than 1 inch, yet more narrowly larger than 2 inches, yet more narrowly longer than 3 inches, yet more narrowly longer than 4 inches, yet more narrowly longer than 5 inches, yet more narrowly longer than 6 inches, yet more narrowly longer than 8 inches, yet more narrowly longer than 10 inches, yet more narrowly longer than 12 inches. The shoelace end section 6*a* and/or 6*b* may be shorter than 12 inches, yet more narrowly shorter than 10 inches, yet more narrowly shorter than 8 inches, yet more narrowly shorter than 6 inches, yet more narrowly shorter than 5 inches, yet more narrowly shorter than 4 inches, yet more narrowly shorter than 3 inches, yet more narrowly shorter than 2 inches, yet more narrowly shorter than 1 inch. The shoelace end section 6*a* and/or 6*b* may differ from the remainder of the shoelace 3; for example the shoelace end section 6*a* and/or 6*b* may be a different color, diameter, material, geometry, shape, texture and/or have different friction characteristics than the remainder of the shoelace 3. The shoelace end section 6*a* and/or 6*b* may have a different cross-sectional area and/or geometry than the remainder of the shoelace 3. The shoelace end section 6*a* and/or 6*b* may have different properties than the remainder of the shoelace 3 for aesthetics, ergonomics (e.g., the ability to easily/clearly differentiate the shoelace end section 6*a* and/or 6*b* and/or have different grip characteristics). The shoelace termination 5*a* and/or 5*b* may secure the ends of the shoelace 3 permanently to the shoe 1 such that the shoelace 3 cannot be removed from the vamp 8 and/or completely unlaced. The shoelace termination 5*a* and/or 5*b* may secure the ends of the shoelace 3 permanently to the shoe 1 such that the shoelace 3 cannot be removed from the shoe 1 and/or unlaced. An additional section of shoelace 3 may extend past the shoelace termination 5*a* and/or 5*b*; for example the shoelace 3 may extend into the inside of the shoe 1 and/or within a lining of the shoe 1. The shoelace termination 5*a* and/or 5*b* may be reversible so that the shoelace 3 can be replaced and/or re-laced. The shoelace termination 5*a* and/or 5*b* may prevent the shoelace end section 6*a* and/or 6*b* from contacting the ground and/or the base of the shoe 1. The shoelace termination 5*a* and/or 5*b* may prevent the shoelace end section 6*a* and/or 6*b* from getting caught on objects that could cause the shoelace 3 to become dirty and/or untied. The shoelace termination 5*a* and/or 5*b* may prevent the loop 7*a* and/or 7*b*, the shoelace 3, and/or the loop knot 4 from being untied accidentally. The shoelace 3 may be untied by pulling on the shoelace end section 6*a* and/or 6*b*.

Figure 2:
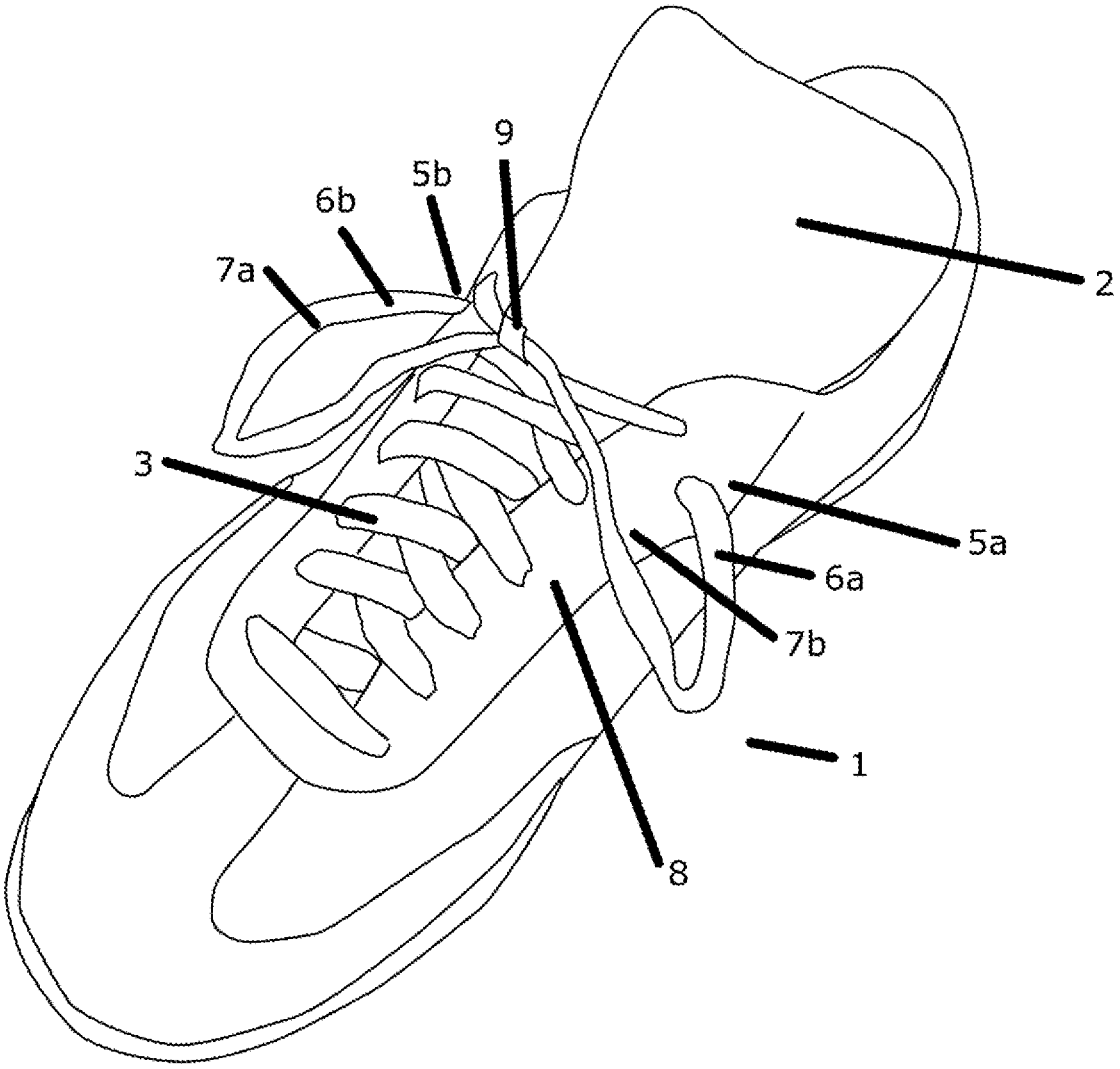
FIG. 2 is an illustrative isometric view of a variation of the shoe in a partially untied configuration and/or partially tied configuration

FIG. 2 illustrates that the shoelace 3 can be in a partially tied configuration and/or a partially untied configuration where an overhand knot 9 may be present, but the loop knot 4 may not be present. The overhand knot 9 may be overhand knot, a square knot, a bowline, a slip knot, a bow, or any other suitable knot for tying the shoelace 3. The overhand knot 9 may be a crossing of the shoelace 3, for example the shoelace ends 6*a* and/or 6*b* may be crossed and/or threaded over one another to make a knot. The overhand knot 9 may be formed by crossing the shoelace ends 6*a* and/or 6*b* so that they form an "X" in the air; wrapping the bottom lace of the "X" over and through the top lace of the "X". The shoelace termination points 5*a* and/or 5*b* may prevent the shoelace end section 6*a* and/or 6*b* from becoming detached from the vamp 8 and/or any other section of the shoe 1. To tie the shoelace 3 into a bow as shown in FIG. 1, the loops 7*a* and/or 7*b* may be tied into the loop knot 4 over the overhand knot 9 (e.g., upon completion of tying the loop knot 4, the loops 7*a* and/or 7*b* may have switched to opposite sides of the shoe 1, so that the loop 7*a* is where the loop 7*b* was previously located). The loop knot 4 may be tied in a similar procedure to an overhand knot: the loop knot 4 may be formed by crossing the loops 7*a* and/or 7*b* so that they form an "X" in the air; wrapping the bottom loop of the "X" over and through the top loop of the "X". A second overhand knot may be tied to form a double-knot.

Figure 3:
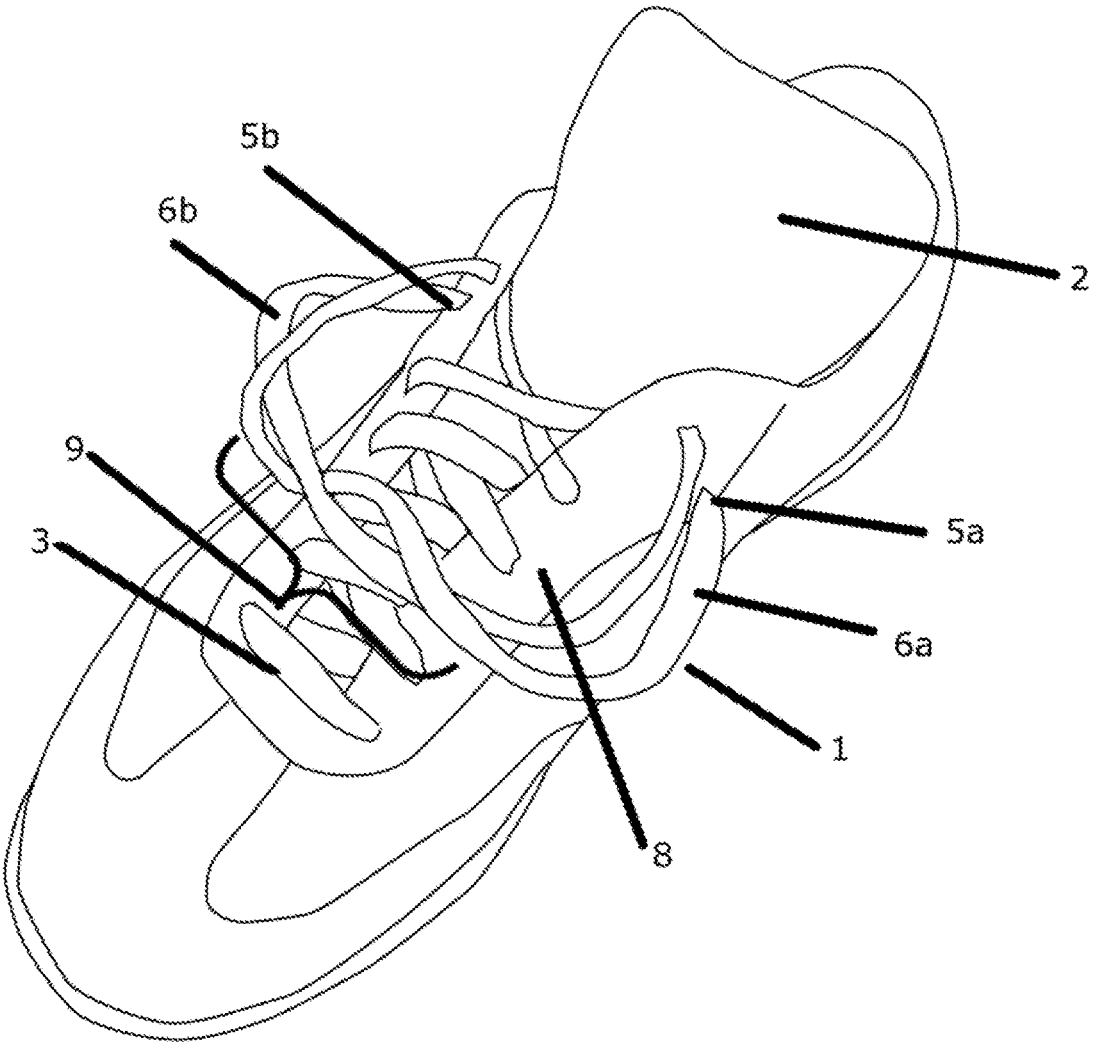
FIG. 3 is an illustrative isometric view of a variation of the shoe in the fully untied and/or loosened configuration.

FIG. 3 illustrates that when the shoelace 3 is loosened, the shoelace end section 6*a* and/or 6*b* may remain secured to the vamp 8 and/or any other section of the shoe 1. The overhand knot 9 is shown in a loosened configuration. For example, pulling on the shoelace end sections 6*a* and/or 6*b* may cause the overhand knot 9 to tighten into the configuration shown in FIG. 2. The shoelace 3 may be loosened sufficiently to allow an object (e.g., a foot and/or other object) to enter and/or exit the shoe. The shoelace 3 may be of an appropriate length to ensure or mitigate the shoelace 3 from touching the ground, even when in the loosened configuration. To tie the shoelace 3 into a knot and/or bow, the shoelace 3 may be pulled taught to form the loops 7*a* and/or 7*b* and/or tighten the overhand knot 9; then, the loops 7*a* and/or 7*b* may be tied into a loop knot 4. The shoelace 3 may be elastic and/or not elastic.

The shoe 1 or any or all elements of the apparatuses described herein can be made from or coated with, for example, single or multiple stainless steel alloys, steel, spring steel, nickel titanium alloys (e.g., Nitinol), cobalt-chrome alloys (e.g., ELGILOY® from Elgin Specialty Metals, Elgin, Ill.; CONICHROME® from Carpenter Metals Corp., Wyomissing, Pa.), nickel-cobalt alloys (e.g., MP35N® from Magellan Industrial Trading Company, Inc., Westport, Conn.), molybdenum alloys (e.g., molybdenum TZM alloy), tungsten-rhenium alloys, polymers such as polyethylene teraphathalate (PET), polyester (e.g., DACRON® from E. I. Du Pont de Nemours and Company, Wilmington, Del.), polypropylene, aromatic polyesters, such as liquid crystal polymers (e.g., Vectran, from Kuraray Co., Ltd., Tokyo, Japan), ultra high molecular weight polyethylene (i.e., extended chain, high-modulus or high-performance polyethylene) fiber and/or yarn (e.g., SPECTRA® Fiber and SPECTRA® Guard, from Honeywell International, Inc., Morris Township, N.J., or DYNEEMA® from Royal DSM N.V., Heerlen, the Netherlands), polytetrafluoroethylene (PTFE), Parylene poly(p-xylylene) polymers, Parylene N, Parylene C, Parylene D, expanded PTFE (ePTFE), polyether ketone (PEK), polyether ether ketone (PEEK), polycarbonate (PC), Acrylonitrile Butadiene Styrene (ABS), poly ether ketone ketone (PEKK) (also poly aryl ether ketone ketone), cotton, polyester, PET, PETG, leather, jute, hemp, nylon, polyether-block co-polyamide polymers (e.g., PEBAX® from ATOFINA, Paris, France), aliphatic polyether polyurethanes (e.g., TECOFLEX® from Thermedics Polymer Products, Wilmington, Mass.), polyvinyl chloride (PVC), Nylon, Vinyl, polyurethane, thermoplastic, fluorinated ethylene propylene (FEP), absorbable or resorbable polymers such as polyglycolic acid (PGA), poly-L-glycolic acid (PLGA), polylactic acid (PLA), poly-L-lactic acid (PLLA), polycaprolactone (PCL), polyethyl acrylate (PEA), polydioxanone (PDS), and pseudo-polyamino tyrosine-based acids, extruded collagen, silicone, zinc, echogenic, radioactive, radiopaque materials, a biomaterial (e.g., cadaver tissue, collagen, allograft, autograft, xenograft, bone cement, morselized bone, osteogenic powder, beads of bone), a material with high strength (60 ksi) and biocompatibility, any of the other materials listed herein or combinations thereof. Examples of radiopaque materials are barium sulfate, zinc oxide, titanium, stainless steel, nickel-titanium alloys, tantalum and gold. The device can be made from substantially 100% PEEK, substantially 100% titanium or titanium alloy, or combinations thereof.

It is apparent to one skilled in the art that various changes and modifications can be made to this disclosure, and equivalents employed, or combinations of any of the disclosed elements, characteristics, features, devices, tools, steps, or methods without departing from the spirit and scope of the invention. Any of the disclosed elements, characteristics, features, devices, tools, steps, or methods can be present as a singular or as a plurality regardless of whether the elements, characteristics, features, devices, steps, or methods are explicitly disclosed herein as being singular or as a plurality. Elements shown with any variation are exemplary for the specific variation and can be used on other variation within this disclosure.

I claim:

1. A shoe comprising: a shoelace having shoelace ends, a tongue and a vamp, wherein the vamp has a first right eyelet, a second right eyelet, a third right eyelet, a first left eyelet, a second left eyelet, and a third left eyelet; wherein the shoelace includes a left tip and a right tip, wherein the right tip of the shoelace is permanently secured to the vamp at a right shoelace termination; wherein the left tip of the shoelace is permanently secured to the vamp at a left shoelace termination; wherein the left and right tips of the shoelace are permanently secured to the vamp with at least one of thread, string, or yarn; wherein the first right eyelet is the right eyelet closest to the right shoelace termination; wherein the first left eyelet is the left eyelet closest to the left shoelace termination; wherein the shoelace is not elastic; wherein the shoelace extends from the left shoelace termination to the first right eyelet, from the first right eyelet to the second left eyelet, from the second left eyelet to the third right eyelet, from the third right eyelet to the third left eyelet, from the third left eyelet to the second right eyelet, from the second right eyelet to the first left eyelet, from the first left eyelet to the right shoelace termination; wherein an overhand knot is always present in the shoelace when the shoe is in a loosened configuration, a partially tied configuration or a tied configuration; wherein in the tied configuration there is at least one more additional knot in the shoelace than in the untied configuration; and wherein the entire shoelace is configured to be elevated above the ground when in the loosened configuration, the partially tied configuration, or the tied configuration when the shoe is resting on a horizontal ground surface.

2. The shoe of claim 1, wherein each of a left shoelace end section and a right shoelace end section are colored differently than the remainder of the shoelace.

3. The shoe of claim 1, wherein each of a left shoelace end section and a right shoelace end section are textured differently than the remainder of the shoelace.

4. The shoe of claim 1, wherein the shoe is laced in a lattice, ladder, zipper, double back, loop back, bushwalk, sawtooth, footbag, display, hash, twisty, hidden knot, riding bow, checkerboard, or bi-colour configuration.

* * * * *